US006857713B1

(12) United States Patent
Kuelbs et al.

(10) Patent No.: US 6,857,713 B1
(45) Date of Patent: Feb. 22, 2005

(54) COILED HOSE STORAGE CABINET

(75) Inventors: Gregory G. Kuelbs, Westlake, TX (US); Gustav P. Kuelbs, Westlake, TX (US)

(73) Assignee: World Factory, Inc., Southlake, TX (US)

( * ) Notice: Subject to any disclaimer, the term of this patent is extended or adjusted under 35 U.S.C. 154(b) by 0 days.

(21) Appl. No.: 10/447,092

(22) Filed: May 28, 2003

Related U.S. Application Data

(60) Provisional application No. 60/383,969, filed on May 28, 2002.

(51) Int. Cl.[7] ..... E04B 1/32

(52) U.S. Cl. ..... 312/248; 312/293.2

(58) Field of Search ..... 312/245, 242, 312/244, 223.6, 326, 327, 293.2, 248; 206/389, 471, 470

(56) References Cited

U.S. PATENT DOCUMENTS

| | | | | | |
|---|---|---|---|---|---|
| 3,027,215 | A | * | 3/1962 | Duncan | 312/245 |
| 3,490,601 | A | * | 1/1970 | Warn, Sr. et al. | 312/248 |
| 3,918,782 | A | * | 11/1975 | Allmand | 312/204 |
| 3,930,702 | A | * | 1/1976 | Pichowicz | 312/245 |
| 4,189,195 | A | * | 2/1980 | Turney et al. | 312/209 |
| 5,562,163 | A | * | 10/1996 | Sartain et al. | 169/51 |
| 5,800,027 | A | * | 9/1998 | Dunn | 312/138.1 |
| 6,113,202 | A | * | 9/2000 | Germano | 312/245 |

* cited by examiner

*Primary Examiner*—Milton Nelson, Jr.
(74) *Attorney, Agent, or Firm*—Melvin A. Hunn

(57) ABSTRACT

A coiled hose storage cabinet is disclosed. The storage cabinet has a back portion, side portions connected to the back portion, and a front portion hingedly connected to the back portion. The cabinet includes an interior U-shaped storage channel for receiving and storing a length of coiled hose.

14 Claims, 3 Drawing Sheets

COILED HOSE STORAGE CABINET

This application claims the benefit of U.S. Provisional Application No. 60/383,969, filed 28 May 2002, titled "Coiled Hose Storage Cabinet."

BACKGROUND OF THE INVENTION

1. Field of the Invention

The present invention relates to hose storage devices. In particular, the present invention relates to devices for storing coiled hoses.

2. Description of the Prior Art

Coiled hoses have been around for many years. However, their use has generally been limited to industrial hydraulic and pneumatic applications. Only recently have coiled hoses seen widespread residential use as water hoses. Developments in the materials that the coiled hoses are made of have provided the necessary capacity for coiled hoses to be useful as residential garden hoses. The primary benefit of coiled hoses is that a relatively long length of hose can be stored in a small space.

Although coiled water hoses require a relative small amount of space for storage, they have a tendency to become entangled if they are not stored in an organized fashion that prevents the coils from overlapping each other. For example, if a coiled hose is wound up and placed over a conventional hook or hose rack, the individual coils overlap each other and the coiled hose becomes entangled. Loosening the entangled coiled hose can be quite time consuming and frustrating.

One solution has been to provide a wire rack that can be attached to the side of a house or building for holding the coiled hose. Although this solution keeps the coiled hose from becoming entangled, it is unsightly and does not provide an enclosed storage environment for the coiled hose.

Therefore, although coiled hoses offer many advantages when used as residential outdoor water hoses, significant shortcomings remain in the area of coiled hose storage devices.

SUMMARY OF THE INVENTION

There is a need for a storage cabinet for a coiled hose.

Therefore, it is an object of the present invention to provide a storage cabinet for a coiled hose.

This object is achieved by providing a storage cabinet having a back portion, side portions connected to the back portion, and a front portion hingedly connected to the back portion. The cabinet includes an interior U-shaped storage channel for receiving and storing a length of coiled hose.

The present invention provides significant advantages, including: (1) the coiled hose can be stored in an enclosed cabinet, thereby protecting the coiled hose from exposure to the environment and prolonging the life of the coiled hose; (2) the coiled hose can be stored in an organized fashion, thereby reducing tangles; (3) the cabinet is more aesthetically pleasing, and can be ornamentally decorated; (4) the cabinet allows the coiled hose to be stored above the ground; and (5) multiple cabinets can be combined together in a modular fashion to allow for storage of very long or multiple coiled hoses.

DETAILED DESCRIPTION OF THE INVENTION

Figure 1:
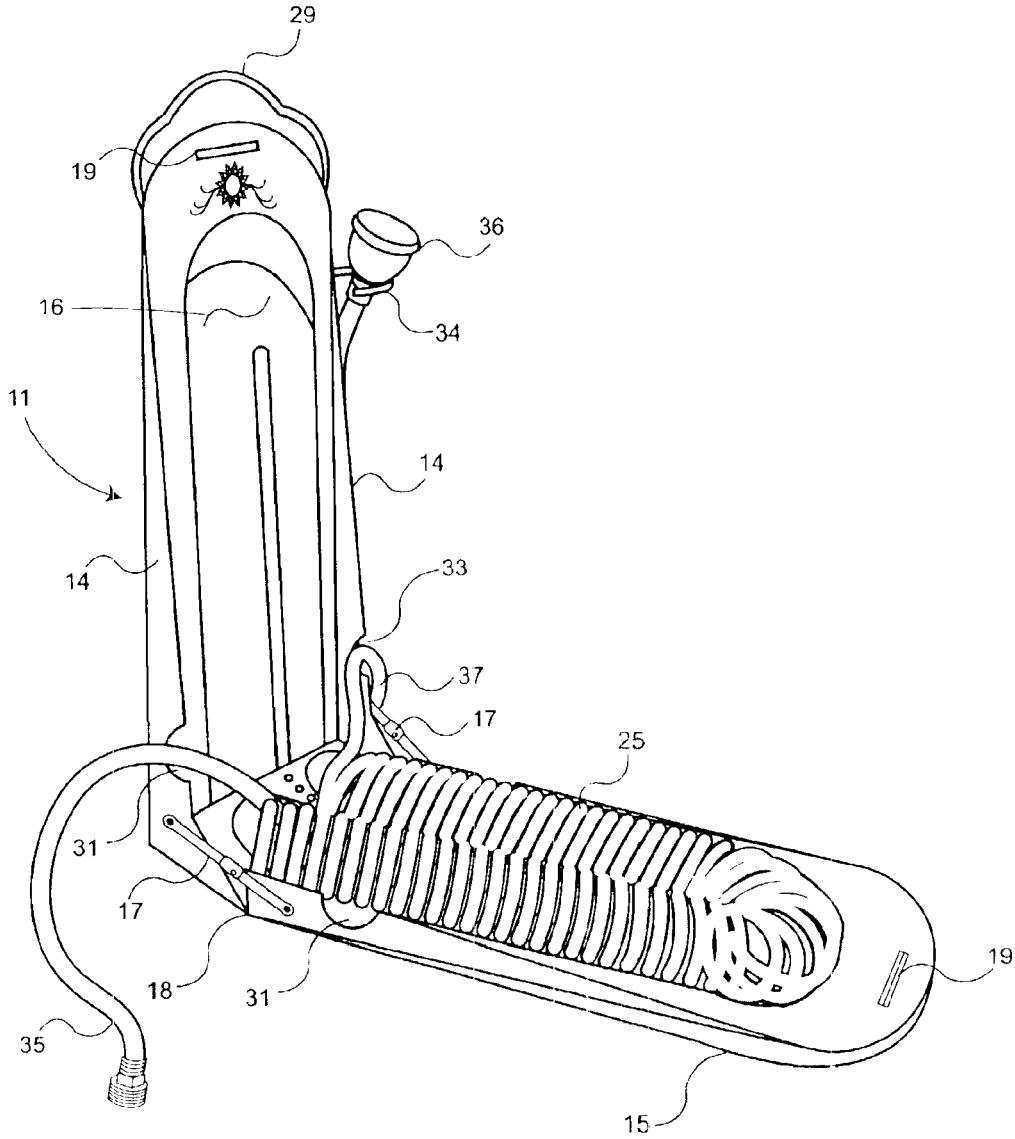
FIG. 1 is a perspective view of the coiled hose storage cabinet according to the present invention shown in an open mode.
Figure 2:
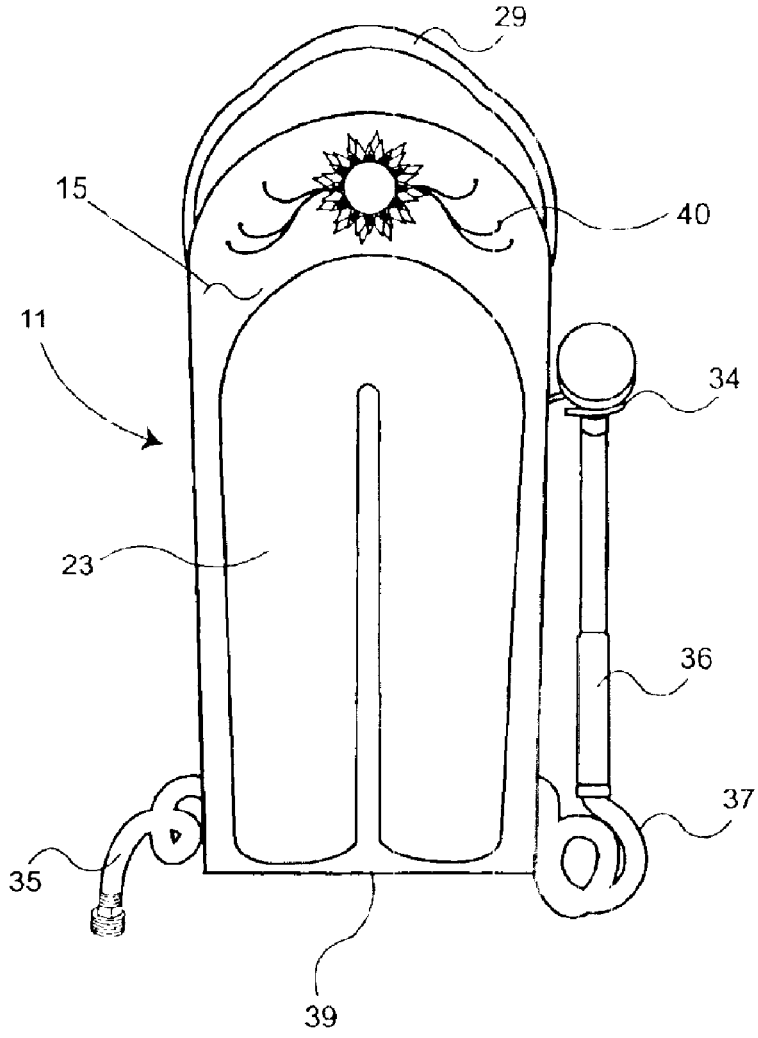
FIG. 2 is a front view of the coiled hose storage cabinet of FIG. 1 shown in a closed mode.
Figure 3:
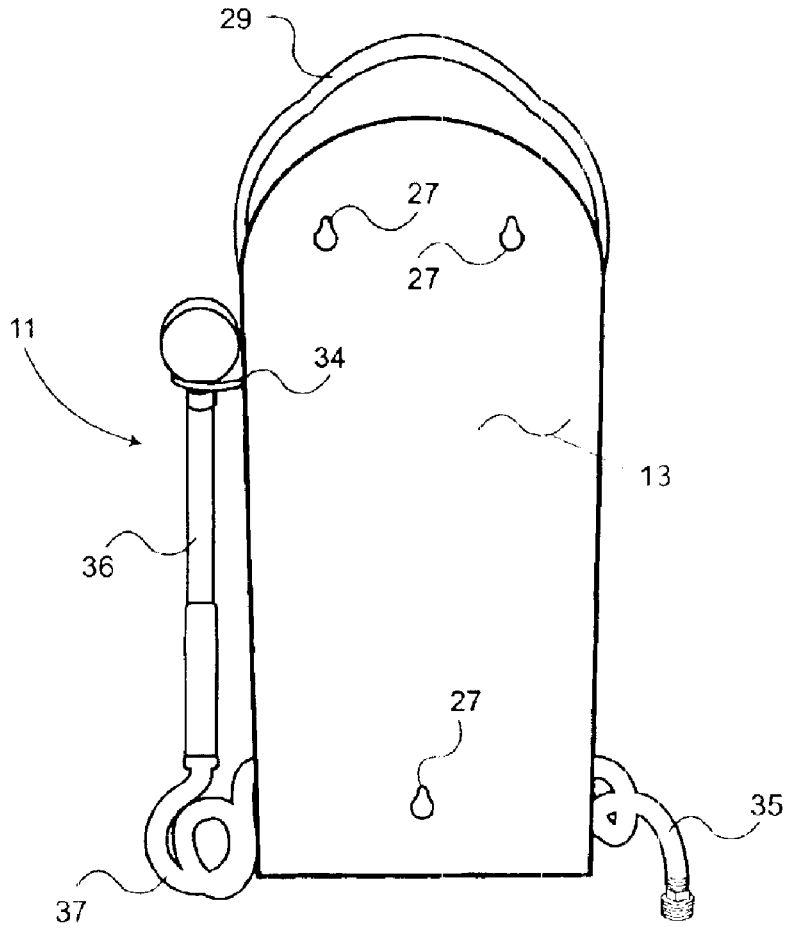
FIG. 3 is a rear view of the coiled hose storage cabinet of FIG. 1.

Referring to FIGS. 1–3 in the drawings, a coiled hose storage cabinet 11 according to the present invention is illustrated. Cabinet 11 has a back portion 13, side portions 14, and a front portion 15 that define a storage compartment 16. Front portion 15 is hingedly connected to back portion 13, preferably at a lower end, by at least one hinge 17, such that cabinet 11 is operable between a closed mode in which front portion 15 is adjacent to back portion 13 and side portions 14; and an open mode in which front portion 15 is rotated forwardly and downwardly away from back portion 13 to allow access to storage compartment 16. At least one support bracket 18, or other support means, is operably associated with front portion 15 to support front portion 15 in a generally horizontal position when cabinet 11 is in the open mode. A latch assembly 19 secures front portion 15 to back portion 13 and side portions 14 when cabinet 11 is in the closed mode.

Cabinet 11 includes an interior U-shaped storage channel 23 for receiving and storing a length of coiled hose 25 in an organized fashion. U-shaped channel 23 may be integrally formed in both back portion 13 and front portion 15. In the preferred embodiment, one side portion 14 includes an inlet port 31, and the other side portion includes an outlet port 33. Inlet port 31 allows an inlet end 35 of coiled hose 25 to pass into storage compartment 16, and outlet port 33 allows an outlet end 37 of coiled hose 25 to pass out of storage compartment 16, regardless of whether cabinet 11 is in the open or closed mode. In this manner, coiled hose 25 may remain attached to a conventional water outlet (not shown) while being stored in cabinet 11. It should be understood that inlet port 31 and outlet port 33 may each be formed in both side portions 14 and front portion 15, as is shown in FIG. 1. Cabinet 11 may include one or more hook members 34 or other attachment means for receiving and holding the ends of coiled hose 25 or attachments that can be connected to coiled hose 25, such as a spray wand 36.

Channel 23 is dimensioned and configured to receive a wide variety of coiled hoses, but preferably coiled garden hoses having outside diameters In a range of about 0.25 inches to 1.0 inches. Channel 23 aids in aligning coiled hose 25 when cabinet 11 is in the closed mode, and aids in aligning and guiding coiled hose 25 into and out of storage compartment 16 when cabinet 11 is in the open mode. Channel 23 prevents the individual coils of coiled hose 25 from becoming entangled with each other.

As is shown in FIG. 2, the front surface of front portion 15 may be contoured to reflect the outline of interior U-shaped channel 23. In addition, front portion 15 may include a decorative design 40 to enhance the appearance of cabinet 11 and make cabinet 11 aesthetically pleasing. Furthermore, front portion 15 may be decorated in a selected motif to match surrounding accessories. For example, decorative design 40 may include a pattern of ivy leaves or an art deco design.

Cabinet 11 may be utilized as a hanging storage case or a portable storage case. A plurality of hanging means, such as apertures 27, are disposed on the rear surface of back portion 13 to facilitate the hanging of cabinet 11 on a wall or other structure when cabinet 11 is used as a hanging storage case.

A handle 29 is coupled to cabinet 11 to facilitate the carrying of cabinet 11 by a user when cabinet 11 is used as a portable storage case. In the preferred embodiment, handle 29 is retractable into back portion 13, such that handle 29 is at least partially hidden from view when not in use. Cabinet 11 includes at least one drainage hole 39 at a lower end for draining fluids and small debris out of storage compartment 16. Enclosed storage compartment 16 allows coiled hose 25 to be stored above the ground, and protects coiled hose 25 from the environment when not in use.

It will be appreciated that multiple cabinets 11 may be combined together in a modular fashion to allow for storage of very long coiled hoses, or multiple coiled hoses connected together. The long coiled hose simply passes from one cabinet 11 to the next through the inlet ports 31 and outlet ports 33. In the hanging storage case application, it is particularly useful to hang two or more cabinets side-by-side. In the portable storage case application, the multiple cabinets 11 can be connected side-to-side, back-to-back, or both. In either application, optional fasteners can be used to connect the multiple cabinets together. These arrangements allow the user to open only as many cabinets 11 and release only as many coiled hoses as are needed for each use, thereby keeping the remaining coiled hoses, enclosed, clean, and untangled.

It is apparent that an invention with significant advantages has been described and illustrated. Although the present invention is shown in a limited number of forms, it is not limited to just these forms, but is amenable to various changes and modifications without departing from the spirit thereof.

We claim:

1. A storage cabinet for a coiled hose comprising:

an enclosure defined by a back portion, opposing side portions connected to the back portion, and a front portion operatively coupled to the back portion;

a U-shaped channel formed in at least the interior surface of the front portion to receive and hold the coiled hose;

wherein the storage cabinet is operable in a closed position in which the front portion is closed against the back and side portions, and an open position in which the front portion is rotated away from the back portion to allow release of the coiled hose.

2. The storage cabinet according to claim 1, further comprising:

wherein said front portion is mechanically connected to said back portion.

3. The storage cabinet according to claim 2, further comprising:

wherein said mechanical connection comprises a hinge.

4. The storage cabinet according to claim 1, further comprising:

a latch assembly to secure the storage cabinet in the closed position.

5. The storage cabinet according to claim 1, further comprising:

an inlet aperture and an outlet aperture through which the ends of the coiled hose may pass.

6. The storage cabinet according to claim 5, wherein the inlet aperture and the outlet aperture are formed in the opposing side portions.

7. The storage cabinet according to claim 5, wherein the inlet aperture and the outlet aperture are formed in both the opposing side portions and the front portion.

8. The storage cabinet according to claim 5, wherein the inlet aperture and the outlet aperture are formed in both the opposing side portions and the back portion.

9. The storage cabinet according to claim 1, wherein the U-shaped channel is also formed in the front surface of the back portion.

10. The storage cabinet according to claim 1, wherein the U-shaped channel is outlined in the front surface of the front portion.

11. The storage cabinet according to claim 1, further comprising:

attachment members adapted to hold accessories for use with the coiled hose.

12. The storage cabinet according to claim 1, wherein the U-shaped channel is dimensioned to correspond to a coiled hose having an outside diameter in the range of about 0.25 inches to 1.0 inches.

13. The storage cabinet according to claim 1, further comprising:

drainage holes through the enclosure to allow drainage of water and debris.

14. The storage cabinet according to claim 1, wherein the storage cabinet is adapted so that multiple storage cabinets can be combined together in a modular fashion.

* * * * *